United States Patent [19]

Barnes

[11] Patent Number: 4,809,685

[45] Date of Patent: Mar. 7, 1989

[54] CHIROPRACTIC TABLE LEVER-LOCKING MECHANISM

[76] Inventor: James E. Barnes, 6734 Penmoken Dr., Fort Wayne, Ind. 46815

[21] Appl. No.: 111,190

[22] Filed: Oct. 22, 1987

[51] Int. Cl.[4] ..... A61H 1/02

[52] U.S. Cl. ..... 128/74; 128/73

[58] Field of Search ..... 128/79–75, 128/80 R, 69; 269/323, 324, 325, 326, 328; 272/144, 145, 903, 72, 117, 118

[56] References Cited

U.S. PATENT DOCUMENTS

| | | | |
|---|---|---|---|
| 1,329,611 | 2/1920 | Kramer | 128/71 |
| 1,417,675 | 5/1922 | Mc Manis | 128/74 |
| 1,448,477 | 3/1923 | Williams | 128/72 |
| 2,381,922 | 8/1945 | Norris | 128/73 |
| 2,445,258 | 7/1948 | Beem | 128/33 |
| 2,601,686 | 7/1952 | Roessler | 128/84 C |
| 3,209,747 | 10/1965 | Guentner | 128/53 |
| 4,489,714 | 12/1984 | Barnes | 128/74 |
| 4,569,339 | 2/1986 | Barnes | 128/73 |
| 4,649,905 | 3/1987 | Barnes | 128/70 |
| 4,724,828 | 2/1988 | Barnes et al. | 128/74 |

*Primary Examiner*—Paul T. Sewell
*Assistant Examiner*—Huong Q. Pham
*Attorney, Agent, or Firm*—Pearne, Gordon, McCoy & Granger

[57] ABSTRACT

A locking device for a chiropractic table is disclosed. The device includes a locking bar slidably received in a locking box. First and second locking plates are pivoted within the box and have locking apertures through which the locking bar extends. The plates are pivotally biased toward each other so that the plates are in a first position wherein locking edges of the aperture grip and lock the bar relative to the box. A rotatable plate is positioned between the plates to move the plates to a second position wherein the locking edges of the plates are out of contact with the locking bar to permit free movement of the locking bar relative to the box.

5 Claims, 2 Drawing Sheets

CHIROPRACTIC TABLE LEVER-LOCKING MECHANISM

BACKGROUND OF THE INVENTION

The present invention relates to chiropractic tables for supporting and manipulating a patient during chiropractic treatment and, in particular, to a table which can be locked in a preselected flexion condition.

Many procedures used by chiropractors in treating their patients utilize a specialized, articulated table for supporting the patient during the procedure. Such tables, well-known in the prior art, typically include an upper and a lower body supporting portion, the two portions defining a patient supporting table. The table is typically padded, adjustable, and articulated so that the patient, lying freely on the table, or strapped thereto, can have the musculoskeletal system manipulated as required for a particular procedure. Manipulation of the table itself is performed by the chiropractor, frequently simultaneously with the application of massage or other manual manipulation.

Typical prior art tables are disclosed in U.S. Pat. Nos. 1,686,979 and 4,569,399. In such prior art tables, it is common practice to provide a lower body supporting portion of the table which is adapted to comfortably raise and lower, bend and rotate the patient's lower back. As to the raising and lowering function of the table, the lower body section of the table is articulated with respect to the mid-portion of the table by a four-bar linkage and is maintained in a horizontal position by a pair of tension springs. The springs may be adjusted to the weight of the lower portion of the table and the weight of the patient's lower body to maintain the patient in a balanced, horizontal position. The practitioner may then manipulate the patient's lower back against the bias of the tension springs to perform extension and flexion treatments on the patient's back. During such treatments, it is desirable to lock the position of the table in a downwardly flexed condition quickly and without slippage of the locking mechanism and the four-bar supporting linkage.

SUMMARY OF THE INVENTION

The present invention provides a chiropractic treatment table which includes a positive locking mechanism for the four-bar linkage which supports the articulated lower or anterior body seciton of the table which underlies the patient adjacent the lower back. The locking mechanism according to this invention comprises a locking device positioned between two relatively slidable members which are pivotally connected to two legs of the four-bar linkage mechanism which links the lower body supporting portion of the table to an upper body supporting portion of the table. In the disclosed embodiment, the locking device includes a rectangular frame or box pivoted to a link supporting the body supporting portion of the table and includes a bar which is slidably received in the rectangular frame and which has one end pivotally connected to another link in the four-bar linkage. A pair of locking plates are pivoted within the frame and are povided with apertures that receive the locking bar. The plates are movable from a spring-biased position in which their apertures engage and securely lock the locking bar to a position wherein they permit free movement of the locking bar. A pivoted release plate operates to unlock the locking plates against the bias of the springs.

DETAILED DESCRIPTION OF THE INVENTION

Figure 1:
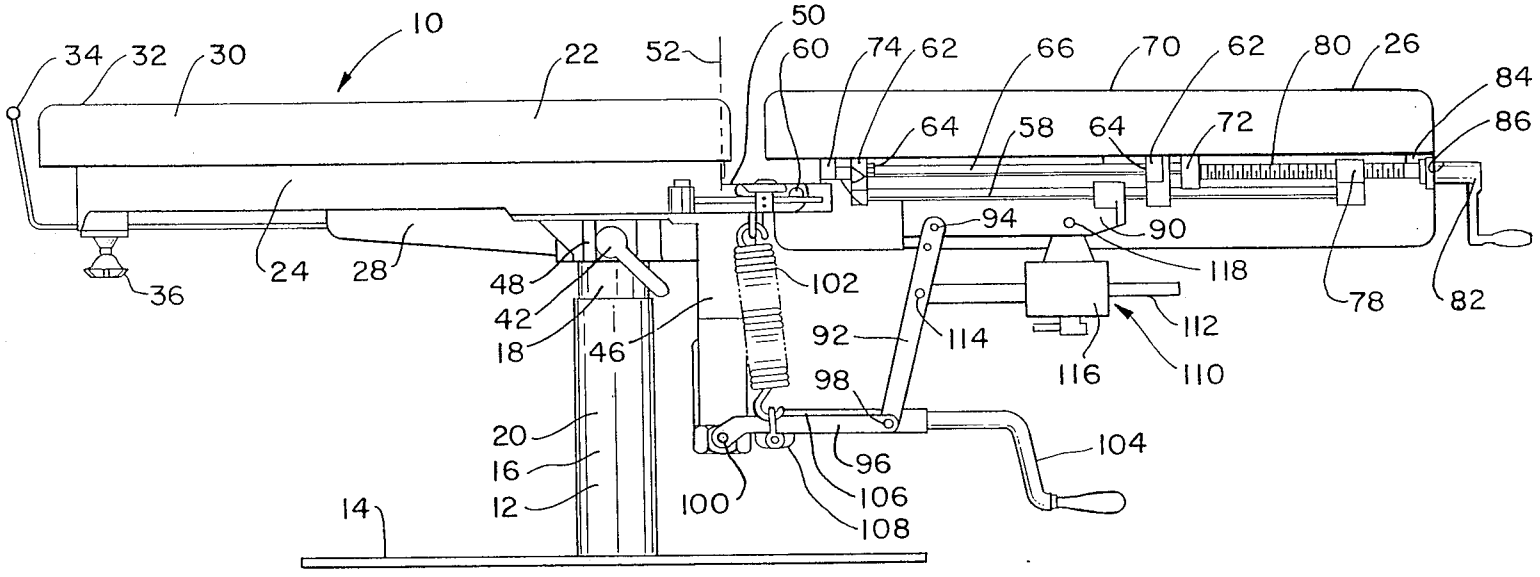
FIG. 1 is an elevational view of a chiropractic treatment table in accordance with the present invention.

Referring now to the drawings, there is illustrated the chiropractic treatment table 10. The table includes a supporting base 12 having a generally flat, rectangular base plate 14 and an upstanding pedestal 16 fixedly secured thereto. Typically, the pedestal 16 includes two telescopically engaged members 18 and 20 to permit vertical adjustment of the table height and rotation therebetween.

A body supporting table 22 is mounted on the pedestal 16. The table 22 is centrally divided into an upper body supporting portion 24 and a lower body supporting portion 26. The upper body supporting portion 24 is provided with a supporting frame 28 which is fixedly secured to the pedestal member 18 and movable therewith. The upper body supporting portion 24 is further provided with a cushion 30 which may be longitudinally bifurcated at its distal end 32 to facilitate a patient's lying face-down thereon or which may be provided with a head support portion of the type shown in U.S. Pat. No. 4,649,905. A slidably adjustable grab-bar 34 is slidably coupled to the supporting frame 28, the grab-bar 34 being selectively clamped by means of locking knobs 36. The upper body supporting portion 24 is locked in a desired elevated or pivotal position by means of a pedestal clamping lever 42 and associated mechanisms not shown in the drawings.

The frame 28 includes a hollow collar portion 46 formed as a part of a frame member 48, with the collar 46 being spaced from the pedestal 16 toward the lower body support portion 26.

The lower body supporting portion 26 includes a pivot plate structure or hinge 50 by means of which the lower body supporting portion 26 is pivotal relative to the upper body supporting portion 22 about a vertical axis 52. Mounted on the hinge 50 is an elongated, lower body supporting portion frame 58. The frame 58 is pivoted to a pin 60 carried by the hinge 50.

The frame 58 includes a plurality of laterally extending castings 62 which are provided with pivot bearings 64. A rotation shaft 66 is journaled in the bearings 64. The lower body supporting portion 26 includes a bed 70 provided with elongated, laterally extending members 72 and 74 which are fixedly secured to the shaft 66.

A threaded collar 78, an elongated, threaded shaft 80, and a crank 82 couple the frame 58 to the lower body supporting bed 70 by an angle bracket 84 and a collar 86 to permit longitudinal adjustment of the length of the body supporting table 22 and, in particular, the relative position of the lower body supporting portion 26 relative to the upper body supporting portion. The chiropractic treatment table 10 is representative of known tables.

It will be observed that the table 10 is so constructed that the lower body supporting portion 26 can be tilted relative to the horizontal about the pin 60. To permit this movement, there is provided a four-bar linkage system which includes a supporting plate 90 fixed to the frame 58 which, together with the frame 58, comprises one of the links. The remaining links comprise a link 92 pivoted to the plate 90 by a pin 94, a link 96 pivoted to the link 92 by a pin 98, and the collar 46 pivoted at one end to the link 96 by a pin 100 and associated at its other end with the plate 90 and the frame 58 by the pivot pin 60 which is carried by the hinge 50.

The bed 70 and the four-bar linkage are floatingly maintained in their illustrated position by a tension spring 102 which connects the link 96 to the hinge 50. The weight of a patient would tend to displace the bed 70 downwardly about the pin 60. With the patient in position, and with his lower body portion on the bed 70, the practitioner may increase the tension of the spring 102 by rotating a handle 104 to operate a screw shaft 106 which is threaded through a block 108 to draw the spring toward the pivot 98 until the spring pulls the bed 70 and the patient to a horizontal position.

With the patient in the adjusted position, the practitioner may exert pressure on the lower body portions of the patient against the bias of the spring 102.

The four-bar linkage mechanism is permitted to be freely moved, but locked in any desired position by a locking mechanism 110 which includes a locking bar 112 pivotally connected to the link 92 by a pin 114 and a box 116 which slidably receives the bar 112 and which is adapted to lock the bar 112 in a preselected position.

Figure 2:
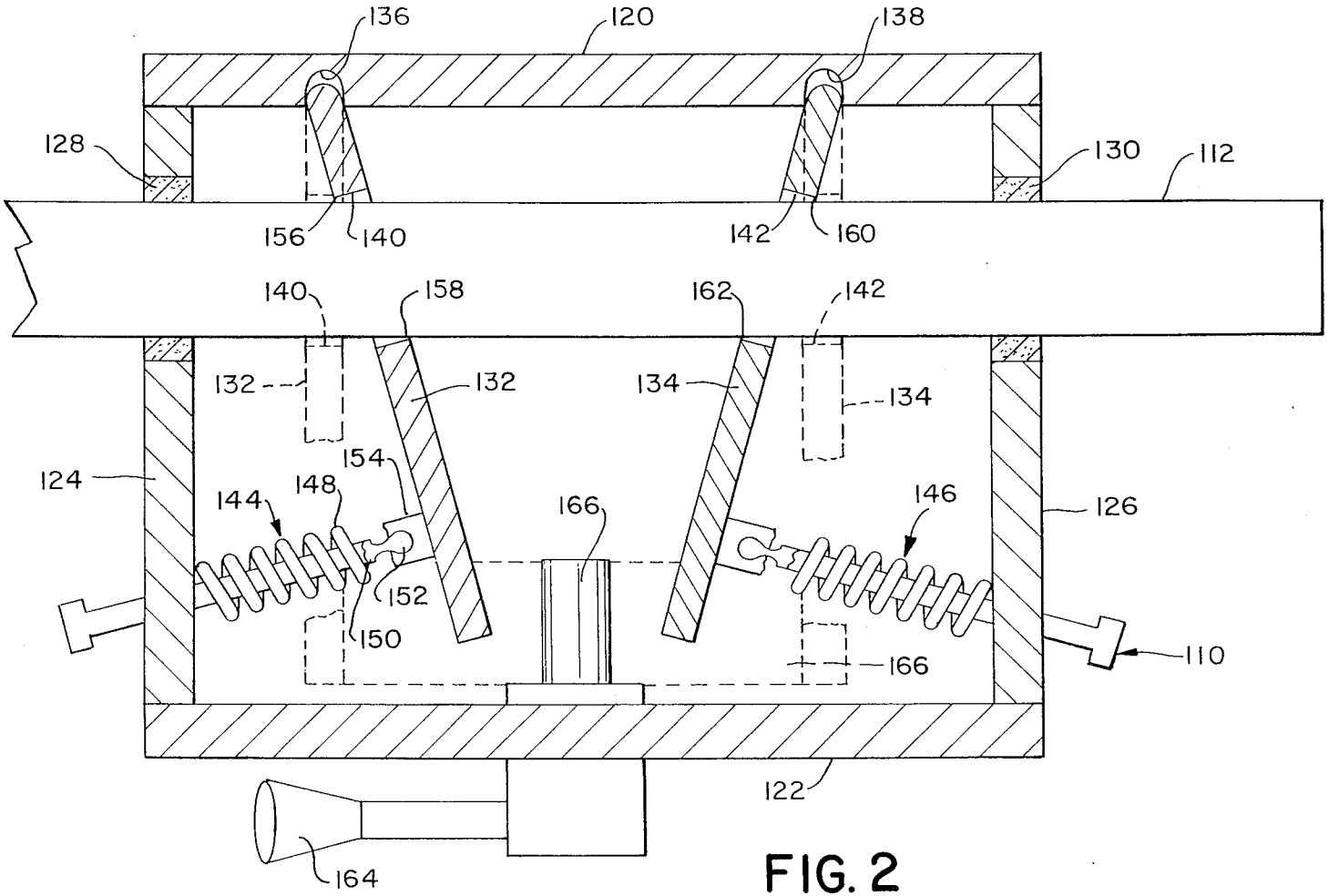
FIG. 2 is a cross-sectional view of the locking mechanism according to this invention.

The box 116 is pivotally mounted on the frame 90 by a pivot pin 118 and, as may be seen most clearly in FIG. 2, comprises top and bottom framing plates 120 and 122 and end plates 124 and 126. The bar 112 is slidably received in bearings 128 and 130 provided in the plates 124 and 126, respectively. The bearings 128 and 130 may be oil-impregnated, porous, metallic bearings of the type well known in the art.

A pair of locking plates 132 and 134 are pivotally received within grooves 136 and 138 provided in the plate 120. The plates 132 and 134 are provided with apertures 140 and 142 through which the bar 112 extends. The longitudinal dimensions of the apertures 140 and 142 exceed the corresponding longitudinal dimension of the bar 112. The distal ends of the plates 132 and 134 are biased together by spring mechanisms 144 and 146, each of which includes a compression spring 148 and a rod 150 having a ball end 152 received in a socket 154. The sockets 154 are fixed to the plates 132 and 134 and the rods 150 slidingly project through the plates 124 and 126. The springs 148 urge the plates 132 and 134 together and cant the apertures 140 and 142 so that aperture edges 156 and 158 associated with the aperture 140 and aperture edges 160 and 162 associated with the aperture 142 are biased into engagement with the rod 112. Any tendency of the bar 112 to move in one direction is resisted by the tendency of the edges 162 and 156 to bite into the bar, while any tendency of the bar to move in the opposite direction causes the edges 158 and 160 to bite into the bar.

It has been found that optimum locking conditions obtain if the plates 132 and 134 define an angle of about 15 degrees with respect to the vertical when the plates are in a locked condition. Angles less than 15 degrees do not provide sufficient locking forces on the bar 112 and angles greater than 15 degrees necessitate relatively large apertures 140 and 142 and relatively deep grooves 136 and 138.

The assembly shown in FIG. 2 is illustrated in solid outline as being in a locked condition. To unlock the mechanism, a handle 164 is rotated 90 degrees from its illustrated position. The handle 164 is associated with a separation plate 166 which is movable by the handle 164 from the position illustrated in solid outline in FIG. 2 to the position indicated in phantom outline. Spring-biased detent mechanisms (not shown) may be provided to releasably retain the handle 164, and therefore the plate 166, in the two positions described above.

When the handle 164 is operated, the plate 166 urges the plates 132 and 134 to their phantom outline positions, and the apertures 140 and 142 freely permit movement of the bar 112 in the bearings 128 and 130 without contact by the plates 132 and 134, and therefore without any frictional interference in this movement. The plates 132 and 134 securely lock the lower portion of the table against movement by a 90-degree movement of the handle 164 and may unlock that portion of the table by movement of the handle 164 in the opposite direction. It may be noted that while the table portion is in an unlocked position, the table may freely move against the bias of the spring 102, since the bar 112 is mounted in the bearings 128 and 130.

Although the preferred embodiment of this invention has been shown and described, it should be understood that various modifications and rearrangements of the parts may be resorted to without departing from the scope of the invention as disclosed and claimed herein.

What is claimed is:

1. A chiropractic table comprising:

a supporting base;

an elongated body supporting table mounted on said base and being centrally divided into upper and lower body supporting portions;

said upper body supporting portion having a first frame member fixed to said base and said lower body supporting portion having a second frame member hinged at one end to said first frame member by a first horizontal pivot pin permitting downward arcuate movement of said lower body supporting portion;

a four-bar linkage mechanism connecting said body supporting portions;

said four-bar linkage having four linkage pivotally members connected together including said first and second frame members, a first link and a second link;

said first and second links being pivotally connected together at one end and being respectively pivotally connected at their other ends to said first and second frame members;

locking means for locking said four-bar linkage in a preselected position, and therefore the position of the lower body supporting portion relative to the position of the upper body supporting portion;

said locking means comprising a locking bar pivotally connected at one end to one of said linkage members and having a locking box means pivotally connected to another of said linkage members;

said box means including top and bottom frame members and end plate means;

said locking bar extending through bearing apertures in said end plate means;

first and second locking plates pivoted to said top frame member;

said locking plates having locking apertures therethrough and receiving said locking bar;

said locking apertures having locking edges;

biasing means urging said locking plates pivotally toward each other so that said plates are in a first position wherein said locking edges grip and lock said locking bar relative to said box means;

unlocking means comprising separating plate means interposed between said locking plates; and means to rotate said separating plate means to pivot said locking plates against the bias of said biasing means to a second position wherein said locking apertures are out of contact with said locking bar to permit free movement of said locking bar in said bearing apertures.

2. A chiropractic table according to claim 1, wherein said locking plates are received in grooves provided in said top frame member.

3. A chiropractic table according to claim 1, wherein said biasing means for each said locking plate comprises a rod pivotally connected to each locking plate and slidably extending through said end plate, means and a compression spring extending between said end plate and said locking plate.

4. A chiropractic table according to claim 1, wherein said locking box means is pivotally connected to said second frame member and wherein said locking bar is pivotally connected to said second link.

5. A chiropractic table according to claim 1, wherein said locking plates define an angle of 15 degrees with respect to a line perpendicular to said locking bar when said plates are in said first position.

* * * * *

UNITED STATES PATENT AND TRADEMARK OFFICE

CERTIFICATE OF CORRECTION

PATENT NO. : 4,809,685

DATED : March 7, 1989

INVENTOR(S) : James E. Barnes

It is certified that error appears in the above-identified patent and that said Letters Patent is hereby corrected as shown below:

In the Abstract, line 7,"aperture" should be --apertures--

Column 1, line 64,"povided" should be --provided--

Column 4, lines 44 and 45, "pivotally members" should be --members pivotally--

Column 6, line 4, "plate, means" should be --plate means,--

Signed and Sealed this

Fourteenth Day of November, 1989

*Attest:*

JEFFREY M. SAMUELS

*Attesting Officer* *Acting Commissioner of Patents and Trademarks*